US005369623A

United States Patent [19]

Zerangue

[11] Patent Number: 5,369,623

[45] Date of Patent: Nov. 29, 1994

[54] ACOUSTIC POOL MONITOR WITH SEQUENTIALLY ACTUATED MULTIPLE TRANSDUCERS

[75] Inventor: Frank Zerangue, Garland, Tex.

[73] Assignee: Rotor Dynamics Americas, Inc., Fort Worth, Tex.

[21] Appl. No.: 987,019

[22] Filed: Dec. 7, 1992

[51] Int. Cl.[5] ..... G08B 21/00

[52] U.S. Cl. ..... 367/93; 340/540; 340/541; 340/568; 340/573

[58] Field of Search ..... 367/93; 340/568, 540, 340/541, 573

[56] References Cited

U.S. PATENT DOCUMENTS

| | | | |
|---|---|---|---|
| 4,189,722 | 2/1980 | Lerner | 367/93 |
| 4,533,907 | 8/1985 | Thatcher | 340/565 |
| 4,571,579 | 2/1986 | Woolley | 340/566 |
| 4,604,610 | 8/1986 | Baker et al. | 340/566 |
| 4,747,085 | 5/1988 | Dunegan et al. | 367/93 |
| 4,853,691 | 8/1989 | Kolbatz | 340/566 |
| 4,932,009 | 6/1990 | Lynch | 367/153 |

*Primary Examiner*—Glen Swann
*Attorney, Agent, or Firm*—William D. Jackson

[57] ABSTRACT

For use in detecting the presence of a foreign body in liquid, such as a swimming pool or the like, at least one transducer support is immersed in the swimming pool or other body of liquid to be monitored. The transducer support has a plurality of transducer means mounted on the support which are capable of sending and receiving acoustic energy. The present invention also comprises a control means for sequentially activating the transducers to generate a series of time-spaced acoustic pulses sequentially from the transducers, and a means responsive to changes in a reflected echo pattern received at one of the transducer means for the expiration of a pre-determined time period, and thus indicative of a foreign object in the transmission path for generating an appropriate alarm function such as a visual or audio alarm.

48 Claims, 3 Drawing Sheets

ACOUSTIC POOL MONITOR WITH SEQUENTIALLY ACTUATED MULTIPLE TRANSDUCERS

TECHNICAL FIELD

The present invention relates to a method and apparatus for monitoring for intrusion by an object in a body of liquid and more particularly, for monitoring an unattended swimming pool for accidental or unauthorized entry of a foreign object, such as a small child or animal, into the pool.

BACKGROUND OF THE INVENTION

Various monitoring systems for detecting the intrusion of a foreign object in a body of water are known in the art. Such systems typically utilize one of three monitoring techniques: the measurement of water displacement; the detection of transient wave motion using a hydrophone or modified hydrophone; or detection of the amplitude of a sound wave generated by one transducer in the apparatus and received by another.

A system based upon water displacement is disclosed in U.S. Pat. No. 4,189,722 to Lerner, which describes a monitoring apparatus for detecting an intrusion into a pool based on a change in water level. This system employs a hydraulic cavity, partially filled with water, which maintains the average pool water level. The cavity has an upper frequency cut-off point that is low enough not to respond to surface wave action or sudden disturbances. When a large object intrudes into the pool, the water level in the cavity rises in proportion to the water displaced by the intruding object. The hydraulic cavity is a resonant cavity, and its resonant frequency change is detected and, upon exceeding some threshold level, an alarm is sounded. An inherent deficiency in this water displacement approach is that, particularly with very large pools, the water level displacement caused by the intrusion of a relatively small foreign object may be slight and thus may not be detected by the apparatus.

Monitoring devices which use a hydrophone or other device to detect transient wave motion are disclosed in U.S. Pat. Nos. 4,604,610, 4,853,691, 4,533,907 and 4,571,579 and are illustrative. U.S. Pat. No. 4,604,610 to Baker et al. discloses an apparatus which utilizes a submerged hydrophone, sensitive only to the vertical component of underwater wave motion, to detect transient wave motion caused by the intrusion of an object into a pool. Because the apparatus is dependent upon transient wave motion, it may fail to detect the intrusion of a small child or incapacitated individual that smoothly slides into the pool and causes little or no transient wave motion. U.S. Pat. No. 4,853,691 to Kolbatz is directed to a monitoring system that detects transient waves via either a switching element or a microphone. The Kolbatz system may fall to detect a small child or incapacitated person who falls into the pool and causes little or no transient wave motion. On the other hand, this system may generate a false alarm in response to transient wave motion caused by high winds.

U.S. Pat. No. 4,533,907 to Thatcher discloses an alarm system based upon a modified hydrophone to detect underwater transient wave motion. This system employs a long tube that is vertically immersed in the body of water being monitored, thereby trapping a small air cavity at the top of the tube. Underwater wave motion causes a fluctuation of the air pressure in the air cavity. This air pressure fluctuation is detected by a piezoelectric device, converted to an electrical signal, amplified and compared to a threshold value. If the fluctuation exceeds the threshold, an alarm is triggered. Again, this passive approach runs the risk of failing to detect the presence of a person who slides into the pool and does not cause a significant underwater wave front. A similar deficiency is present in the system disclosed in U.S. Pat. No. 4,571,579 to Wooley. The Wooley system employs a high Q hydrophone that is selectively sensitive to sound waves at its resonant frequency. Here, a transducer module immersed in the water has a resonant cavity that has an object inside it capable of freely being agitated by underwater disturbances.

The problems caused by transient motion detecting devices and the potential risk of failing to detect persons who generate little or no underwater wave activity have been remedied somewhat by monitoring devices which employ active sound navigation and ranging techniques and various configurations of transducers such as U.S. Pat. Nos. 4,747,085 and 4,932,009. U.S. Pat. No. 4,932,009 to Lynch, for example, describes a monitoring apparatus with multiple transmitters and receivers set up in a grid-like fashion such that each transmitter sequentially signals its corresponding receiver to establish a plane of detection. An object intruding in this plane will block one of the transmitter receiver pairs and either alter the strength of the sound wave passing between the transducers or completely inhibit its detection. The decrease in strength or complete failure to detect a particular sound wave emitted by the apparatus indicates an alarm condition. Because the apparatus operates by detecting a sound wave actively generated by the apparatus, it detects the intrusion of an object regardless of whether that object generates any type of transient wave motion. However, the device can be extremely costly. Each transmitter receiver pair is based upon underwater sound propagation using ceramic based transducers. As such, a large number of transducers and configurations thereof would likely have to be installed. This could make the cost prohibitive for many pool applications.

U.S. Pat. No. 4,747,085 describes a two transducer system. One transducer converts a continuous electrical signal into an underwater sound wave and the second transducer receives a return continuous sound wave. The theory behind the apparatus is that a continuous sound signal flooding a pool of given geometry will return a unique continuous signal signature. Once this signature is established, any intrusion by a foreign object will disturb or modulate it. This type of system has several deficiencies. First, when a pool is flooded with sound waves, the sound propagates in all directions, reflecting off of side walls and recombining with original waves and other reflections. When original attenuated waves recombine with other reflected waves, the original and reflected waves cancel each other thereby enabling dead zones to develop in the water. These dead zones have no sound waves. Therefore, any object that happens to fail in a dead zone fails to cause a modulation of the signature, and thus is not detected. Secondly, continuously driving a transducer at the power level needed causes very large power dissipation, which is not conducive to battery backup operation and also increases cost.

SUMMARY OF THE INVENTION

In accordance with the present invention there is provided a novel monitoring system for use in detecting the presence of a foreign object in a body of liquid such as a swimming pool or the like. The present invention comprises at least one transducer support which is adapted to be immersed in the swimming pool or other body of liquid to be monitored. The transducer support has a plurality of transducer means mounted on the support. The transducer means are preferably in the form of transceivers, i.e., electro-acoustic transducers which function to both receive and generate acoustic energy. The transducers are configured on the support with the active faces thereof oriented to transmit acoustic energy away from the support in complementary conical transmission paths which define different sectors of the field to be monitored.

The system further comprises a control means for sequentially activating the transducers to generate a series of time spaced acoustic pulses sequentially from the transducers. The time intervals between the pulses are sufficient to permit the arrival of at least one and preferably a plurality of subsequent echoes at one transducer before the sequential generation of another pulse from another transducer.

The system further comprises means responsive to changes in a reflected echo pattern being received at one of the transducer means before the expiration of a predetermined time period, and thus indicative of a foreign object in the transmission path for generating an appropriate alarm function such as a visual or audio alarm.

In a more specific embodiment of the invention, the transducer means are mounted on the transducer support with their active faces oriented in an essentially two-dimensional array to define a substantially planar monitored field. Preferably, the transducer means are configured to radiate acoustic energy in conical transmission paths of an elliptical configuration having a major axis generally oriented in the plane of the monitored field and a minor axis generally normal to the plane of the monitored field. More preferably, the ratio of the major axis to the minor axis is at least two and still more preferably, at least four.

In a specific embodiment of the invention particularly suited to the adaptation of the invention to home swimming pools and the like, the system is configured to generate acoustic energy pulses having pulse durations of no more than 0.1 milliseconds. The control means activates the transducers to produce a time interval between the generation of one acoustic energy pulse from one transducer and the generation of a subsequent acoustic energy pulse from another transducer of at least 40 milliseconds. Preferably, this time interval is within the range of about 40–80 milliseconds, specifically about 50 milliseconds.

In yet a further embodiment of the invention, the signal output from the electro acoustic transducer means which is generated in response to a received acoustic energy pulse is adjusted by a gain control means as a function of the time interval between the generated acoustic pulse and the corresponding echo pulse.

Another aspect of the present invention provides a method of monitoring for the entry of a foreign object into a swimming pool or other body of liquid interposed between a monitoring site and a boundary surface which provides an impedance mismatch with the body of liquid. In carrying out this method, a plurality of time spaced directional acoustic energy pulses are generated from a monitoring site within the body of liquid. The acoustic energy pulses are directed away from the monitoring site along a plurality of spaced conical transmission paths in the direction of the boundary surface. For each of the transmission paths, an echo of the acoustic energy pulse is detected and a normal travel time value is established for the transmission of the acoustic energy from the monitoring site to the boundary surface and the return of a corresponding echo. Preferably, a plurality of echoes resulting from primary and secondary reflections for each transmission path are detected. In the event a reflected echo (or preferably echoes) for a given transmission path is detected at a time increment different than the normal travel time value for the transmission path, an alarm signal is generated. The alarm signal is representative of a foreign object interposed between the monitoring site and the boundary surface. In the case of a swimming pool or the like, the conical transmission paths are spaced horizontally near the surface of the water or other liquid, but sufficiently below the surface to be substantially unaffected by the wave action on the surface of the body of liquid. The preferred normal cross-sections of an elliptical configuration described previously are oriented with the minor axes being generally normal to the surface and terminating at a location within the range of about 6–18 inches below the surface.

Preferably the normal travel times for the respective transmission paths are established during a calibration phase which is instituted each time the monitoring system is energized. Thus, when the monitoring system is initially energized, a first calibration phase is instituted which is followed by a first monitoring phase which continues until the monitoring system is turned off whereupon the generation of acoustic energy pulses from the monitoring site is discontinued. When the monitoring system is thereafter energized for a second time, the transducers are recalibrated in a second calibration phase to establish a recalibrated normal travel time. At the conclusion of this second calibration phase, a second monitoring phase is instituted which continues until the system is again turned off. The monitoring phases are instituted at the conclusion of the calibration phases. This accommodates for changes in acoustic velocity as may occur from time to time due to factors such as temperature variations or changes in solute concentrations in the body liquid being monitored and monitored space geometry.

DETAILED DESCRIPTION OF THE INVENTION

Figure 1:
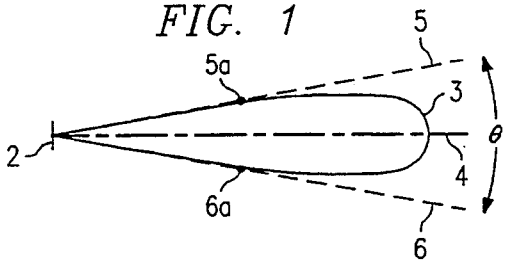
FIG. 1 is an illustration of a directivity pattern of an acoustic transducer.

The principal application of the present invention will be found in relatively small unguarded swimming pools and the invention will be described in detail with reference to this application. However, it is to be understood that the invention can be used in various other applications as well. For example, storage reservoirs and settling ponds may be monitored in accordance with the present invention for the intrusion of foreign objects. The invention may also find application in the monitoring of defined bodies of non-aqueous liquids. For example, petroleum products are often stored in above-ground or in-ground tanks or reservoirs and such reservoirs can be monitored in accordance with the present invention for the intrusion of foreign objects.

The transducers used in carrying out the invention can be of any suitable type. The transducers will, of course, function in response to an applied electrical signal to generate an acoustic signal and to similarly respond to a received acoustic signal to produce an electric output signal. Transducers of the type used in sonar applications can be used in the present invention with suitable modifications to accommodate the fact that the monitored field will be relatively small and normally generally parallel and close to the surface of the water as contrasted with sonar applications where large vertical scans are desired. As will be understood by those skilled in the art, transducers may be in the form of piezo-electric, magnetostrictive or electrostrictive transducers. As a practical matter, it will usually be preferred to use piezoelectric transducers. Regardless of the type, an applied electrical pulse is applied to the transducer to "ping" the transducer and produce an acoustic pulse of brief duration. Preferably, as described in greater detail below, the transducer will be "pinged" to produce a pulse having a duration of about no more than 0.1 milliseconds. The acoustic signal emitted when operating the transducer in a pulse mode may have a multi-frequency spectrum; that is, the signal may be represented in the frequency domain by a relatively broad spectrum sinusoidal components spanning the resonant frequency of the transducer at which the maximum power transfer occurs. An acoustic signal of this nature may be produced by actuating the transducer with a sharp unidirectional voltage pulse to produce an acoustic signal having frequency components at resonance and fractions and multiples of resonance; for example, at frequencies of ½, 2 times, 4 times, etc., of the resonant frequency. Preferably, however, the transducer is "pinged" with an applied AC signal at the resonant frequency of the transducer to produce a narrow band signal; ideally a single frequency signal. By operating the transducer at resonance, the acoustic signal emitted from the transducer is a frequency burst of a sinusoidal wave form at the resonant frequency of the transducer. For example, where the resonant frequency is 500 kHz, as described below, the electrical pulse used to ping the transducer may be applied from an oscillator at 500 kHz for a period of 0.1 millisecond, i.e., 50 cycles at the resonant frequency of 500 kHz. The result will be an acoustic pulse at a duration of 0.1 millisecond at a frequency of 500 kHz, i.e., 50 cycles. The electro-acoustic transducers employed in the present invention preferably generate acoustic pulses having resonant frequencies in a range of about 200–800 kHz and, more preferably, about 500 kHz. This frequency is particularly well suited in terms of the size of the monitored field, the attenuation of the acoustic signal in water which can be tolerated and the size of the active face of the transducer in terms of the desired directivity of the transducer.

Turning now to FIG. 1, there is illustrated a directivity pattern which is representative of the response of a transducer 2 to transmitted and received acoustic energy. In FIG. 1, curve 3 is a polar plot of the pressure amplitude of transmitted or received energy versus angular displacement from a base-line 4 which is normal to the active face of the transducer 2 and which is the axis of the conical transmission path emanating from the transducer. A measure of the directivity of a transducer is the angle $\theta$ through which a response of at least 63% of the maximum pressure amplitude is observed. Thus, as illustrated in FIG. 1, the directivity angle $\theta$ is defined by broken lines 5 and 6 which extend from the intersection of the base-line and the active face of the transducer 5*a* through points 5*a* and 6*a* on curve 3 which correspond to 63% of the maximum pressure amplitude of the generated or received acoustic angle.

While FIG. 1 illustrates only a single primary directivity pattern, the transducer will in practice also generate lateral lobes of lower pressure amplitude than the primary lobe. Thus, as shown schematically in FIG. 2, the transducer 2, in addition to the primary energy lobe 3, can further be characterized in terms of lateral lobes of progressively decreasing amplitudes, as indicated by curves 3*a*, 3*b*, etc.

The transducer means used in the present invention can take the form of electro-acoustic transducers commonly referred to as transceivers which can be used for both the generation and detection of acoustic energy pulses. Alternatively, separate transmitting and receiving transducers can be used. In either case, the electro-acoustic transducers normally will be arranged in a configuration providing a plurality of conforming directivity patterns. By way of example, a typical transducer module may incorporate five to 15 transducer means, each of which are arranged to have conforming complementary directivity patterns to cover the area to be monitored within a desired tolerance limit. Typically, an unmonitored space dimension of perhaps 8 to 10 inches will be permitted as described below related to minimum target diameter.

Figure 3:
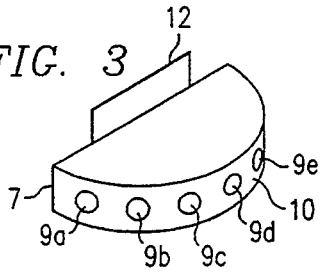
FIG. 3 is an illustration showing a preferred form of a transducer support incorporating a plurality electro-acoustic transducers employed as transceivers.

Turning now to FIG. 3, there is illustrated a perspective view of a transducer support 7 having five transducers 9*a* through 9*e* configured to operate as a transceivers. As illustrated, the outer surface 10 of the transducer support is shaped in a generally semi-circular configuration so as to orient the active faces of the transducers to provide for the appropriate arrangement complimentary directivity patterns. The back surface of the transducer support is relatively flat and can be located in the pool on a vertical wall near the surface of the water and is provided with a mounting bracket 12. The transducer support may be formed of a suitable plastic such as polyurethane or non-corrosive metal such as aluminum. In either case, transducers 9a–9e can be bounded to the outer surface of the transducer support by a suitable bonding material such as an epoxy resin which envelops the transducer and covers the active face of the transducer and holds it to the transducer support.

Where separate transmitting and receiving transducers are employed in a transducer array, they normally will be located with one immediately below the other. Thus, the two transducer counterpart to a transceiver system comprising, for example, five transceivers oriented to provide five complementary transmission patterns will find its separate transmitting and receiving transducer counterpart in an arrangement of ten transducers; five transmitting transducers with corresponding receiving transducers arranged in a second conforming array of transducers located immediately below the first.

Figure 2:
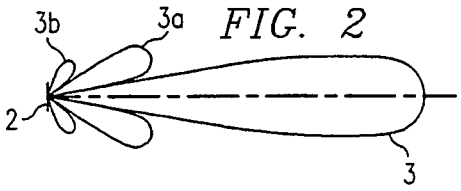
FIG. 2 is an illustration of a directivity pattern of an acoustic transducer and further showing secondary patterns.
Figure 6:
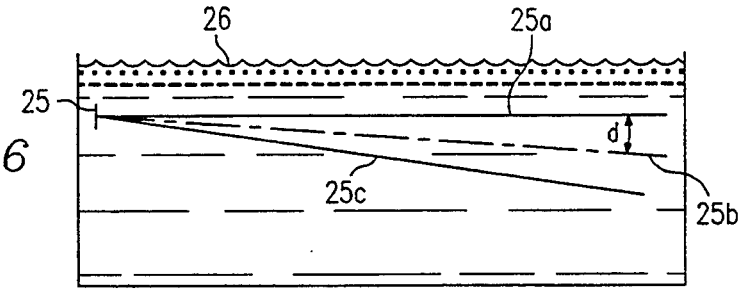
FIG. 6 is a schematic illustration showing a longitudinal view of the primary and secondary transmission patterns of a transducer in relation to the underlying water surface.

The transmission pattern for the transducer 2 shown in FIGS. 1 and 2 may also be defined three dimensionally in terms of a cone having its apex at the active surface of the transducer. As will be understood by the those skilled in the art, the cone can be described in terms of various conic sections, one of which lies in a plain perpendicular to the major axis (base line 4 in FIG. 1 ) around which the cone is described. In a regular cone, this cross-section, which is normal to the axis of the transducer, is a circle. In a preferred embodiment of the invention, the transmission path emanating from the transducer is of a generally elliptical configuration in normal cross section, i.e., in cross-section normal to the axis of the conical section. This elliptical conic section has a major axis, generally horizontal to the surface of the liquid to be monitored with the minor axis generally normal to this surface. This enables the transmission pattern of the transducer to cover a relatively large volume of water immediately below the surface of the water without impinging upon the surface. As noted previously, the surface of a body of liquid such as the water in a swimming pool has a significant impedance mismatch with the air so that the surface can provide a reflective boundary resulting in an erroneous result. The transmission pattern of the transducer should be below the surface of the body of water and tilted as described below with reference to FIG. 6 so that it will not be impacted by wave action on the surface such as may occur due to high wind conditions or by small debris such as leaves. Preferably, the transmission pattern will be at least 8 inches below the surface and tilted downwardly from the horizontal by an angle of about 1–3 degrees. It should, of course, be sufficiently close to the surface to detect even small objects which may slide into the pool at a relatively low angle and thus should normally come to within 6–18 inches of the surface of the pool.

Figure 4:
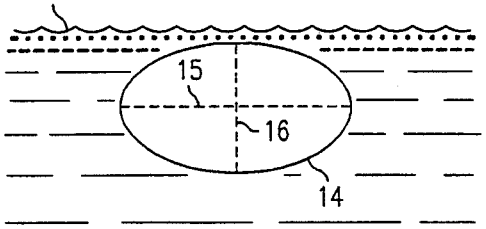
FIG. 4 is a schematic illustration of a conic section of a preferred form of transducer pattern.

A preferred elliptical cross-section as described above and its orientation to the overlying surface of water is illustrated in FIG. 4. As shown in FIG. 4, the elliptical conic section 14 has a generally horizontal major axis 15 and a generally vertical minor axis 16 disposed below the surface 18 of a body of water. The ratio of the major axis 15 to the minor axis 16 preferably is at least 2 and more preferably at least 4. This ratio may range up to about 10 or even more. It will be recognized that the directivity angle $\theta$ as described above with respect to FIG. 1 is measured through the plane of the major axis 15. Returning to FIG. 3, the transducers 9a through 9e should, consistent with the elliptical conic sections described above, be configured with major axes generally aligned along the major (horizontal) dimension of the support 7 and minor axes transversely thereof, i.e., generally vertical.

Figure 5A:
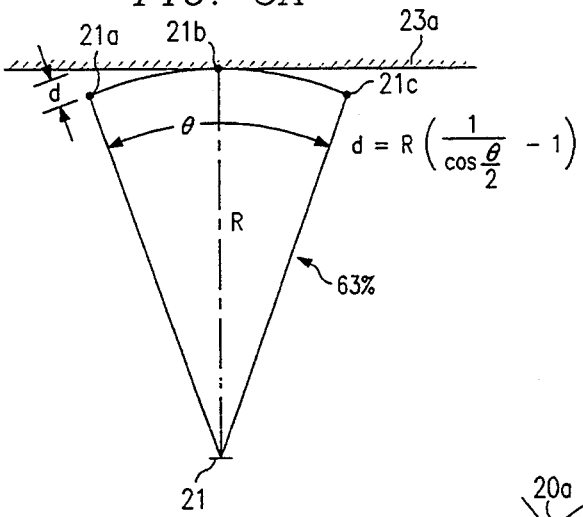
FIGS. 5A and 5B are schematic illustrations showing directivity patterns for a transducer array in relationship to a boundary surface.

Turning now to FIG. 5A, there is illustrated schematically the transmission path from a transceiver 21 having a transmission pattern defined by 21, 21a, 21b, and 21c. Path line segment 21, 21a defines the 63% radiation amplitude boundary of the conical section. Path arc 21a, 21b, 21c defines the directivity angle $\theta$ being equidistant from the source of transmission 21. Boundary line 23a represents the wall of the swimming pool being monitored. Although the walls of a swimming pool need not be flat, and are more likely curved, being concaved or convexed relative to transceiver 21, the straight line boundary illustrates the maximum directivity angle $\theta$ as a function of range R and minimum target diameter d as constrained by the receipt of the primary echo. In a specific embodiment of the invention, the diameter d is no more than 8 inches. This can be characterized as the difference in length of the centerline of radiation, the range R shown in FIG. 5a as depicted by line segment 21–21b, and the distance from transducer 21 measured along line 21–21c or 21–21a to a point on the boundary 23a normal to the radiation centerline R. As shown in FIG. 5A and the formula in FIG. 5A defining d, this point is one-half of the directivity angle from the radiation centerline.

Figure 5B:
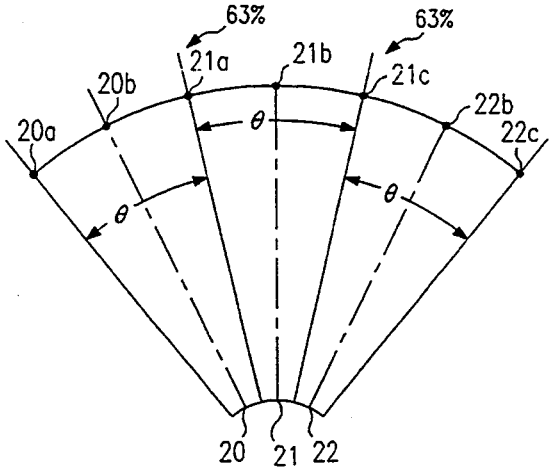

For any given target position, being at point 21a, 21b, or 21c, the time duration from the ping of transducer to receipt of the primary echo is the same for all three target positions. In this scenario, a target of diameter d located between boundary 23a and point 21a could not be distinguished from the boundary 23a by the time of receipt of the primary echo alone. This criterion is used to determine range R and directivity angle $\theta$ based upon the selected minimum target diameter d. Although the preferred embodiment of this invention is not limited or delineated by the above described constraints, since more than the primary echo time information is processed to yield reliable detection even for curved boundaries, the above constraint provides a suitable criterion for choosing directivity angle $\theta$ for a given application or transducer type. FIG. 5B schematically illustrates the relative radiation pattern of an idealized transducer array comprised of three transceivers 20, 21, and 22. In application, the conical radiation pattern of each transceiver actually partially overlaps with the conical radiation pattern of the adjacent transceiver. However, it should be noted that the conical radiation patterns are contiguous at their respective 63% radiation amplitude boundary lines as defined by line segments 20, 20a; 21, 21a; 21, 21c; and 22, 22c. The relative position of the radiation patterns of transceivers 20, 21, and 22 provide a complete detection plane for reliable detection of a target having minimum diameter d as shown in FIG. 5A.

Recalling that the transducer also generates lateral or secondary energy lobes as described above with respect to FIG. 2, it will be recognized that these lobes will likewise produce reflections which are ultimately received back at the transducer 21. However, the acoustic energy signals and "echoes" produced as a result of these lateral lobes will arrive back at the transducer with different time intervals between successive signals because these secondary signals will be reflected from not only the primary reflective surfaces, but also secondary and tertiary reflective surfaces. As described in greater detail below, in the preferred embodiment of the invention, the travel time established during the calibration phase of the system is actually a statistical time value based upon the detection of a plurality of echo pulses. These additional echoes simply provide addition information which when processed enhances detection reliability. Each successive echo signal is, of course, attenuated with respect to the previous signal in accordance with the logarithmic function described below. This is compensated for by the automatic gain control system herein.

Considerations similar to those described above with respect to FIGS. 5A and 5B apply also with respect to the orientations of the transducers and their directivity angles relative to the surface of the swimming pool or other body of water being monitored. As noted above, the 63% boundary of the conical transmission path should be located within the range of 6–18 inches below the surface of the body of water. In this regard and turning now to FIG. 6, there is illustrated a transducer 25 located below the surface of the body of liquid being monitored. The upper boundary of the 63% transmission path 25*a* of the transducer is located within the range of 6–8 inches below the surface 26. To maintain this relation, it is preferred that the active face of the transducer be inclined from the vertical so that axis 25*b* of the transmission pattern be inclined downwardly from the horizontal by an angle $\propto$ within the range of 1–3 degrees. Typically, for most residential pools the angle $\propto$ is 1.8 degrees.

The amplitude of an echo pulse arriving at a receiving transducer depends upon the distance traveled by the primary acoustic pulse, the impedance mismatch between the transmitting medium and the reflecting surface, and the distance traveled by the reflected echo pulse back to the receiving transducer. The attenuation of acoustic signals in water is a function of the frequency of the acoustic signal and is inversely proportional to the square of the distance traveled by the acoustic signal. In the present invention attenuation of the transmitted acoustic pulse and the received echo is compensated for by an automatic gain control system which adjusts the gain on the electrical output signal from the receiving transducer as a function of the time between the transmitted pulse and a received echo, and therefore as a function of the distance traveled by the acoustic energy signal.

Figure 7:
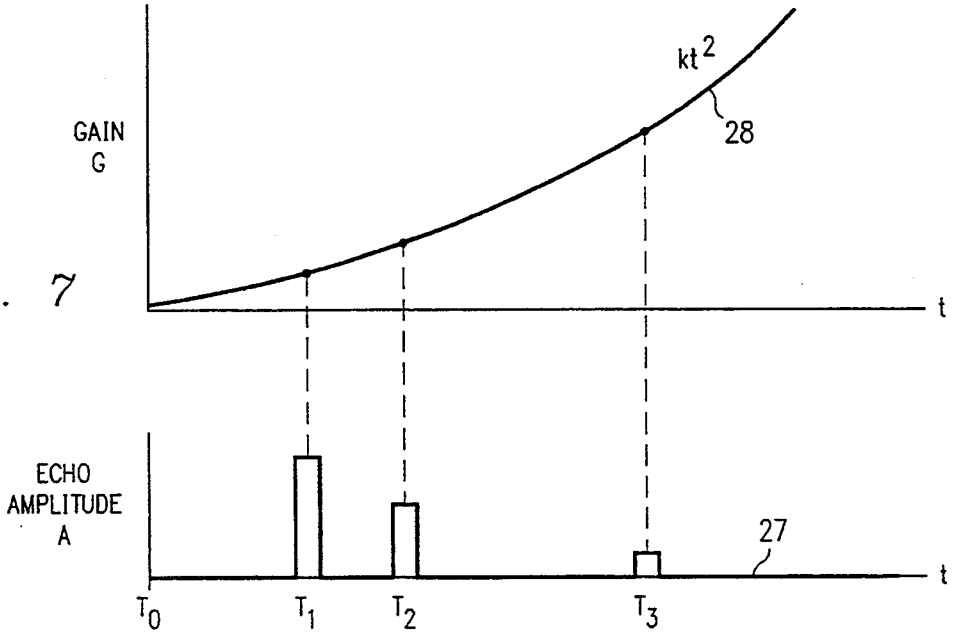
FIG. 7 illustrates the time dependency of the amplitude of reflected echo pulses and exponential gain control operation on the transducer output.

Amplification of the received echo signals output from a transducer is illustrated schematically in FIG. 7. In FIG. 7, curve 27 shows the amplitude A of the voltage signal output from the receiving transducer, as a function of the amplitude of the received acoustic signal at times $T_1$, $T_2$, and $T_3$, and after a time $T_0$, at which the acoustic energy pulse is generated. As described below with reference to FIG. 10, the gain G on the receiving amplifying system is controlled with time in an exponential relationship as indicated by curve 28 of FIG. 7 so that a maximum signal to noise ratio is achieved. It will be recognized that the reflected echo pulses detected at times $T_1$, $T_2$ and $T_3$ may be normal reflections arriving from the side of the pool or the like which serves as the normal reflecting surface as determined during calibration of the system, or they may be alarm pulses reflected from a foreign body in the pool interposed between the transducer array.

As indicated previously, the present invention functions to detect the presence of a foreign object in a body of water by calculating the time elapsed from the generation and emission of a sound wave to the detection of its corresponding echoes and comparing the calculated time to a predetermined calibrated time value. The process is facilitated by a variety of means within the system. These means, their corresponding functions and preferred embodiments of the invention are discussed in detail below.

To oversee the wave generating process, the system is equipped with a means for initiating and coordinating the generation of a sound wave in a body of water being monitored and detection of its corresponding echoes. The initiating and coordinating means includes a microprocessing unit. A suitable microprocessing unit is a commercially available Motorola MC68HC705C8 8-bit microprocessor, which includes an on chip oscillator, memory mapped I/O, selectable memory configurations, timer, clock monitor, 24 bi-directional I/O lines, 7 input only lines and a serial communications interface. A detailed description of the Motorola microprocessor is contained in Motorola publication MC68HC705C8/D Rev 1, Technical Data Manual.

To ensure valid operation of the microprocessing unit when power is applied after a period of non-use, the initiating and coordinating means can also employ a power reset circuit. One example of such a power reset circuit is a TLC555 timer, which is a threshold detect integrated circuit connected in a one shot configuration. When voltage from a power source is applied, the timer outputs an active low reset signal (/POR), which is sustained for a duration of approximately $1.1 \times R \times C$. The signal gives the microprocessing unit sufficient time to reset, guaranteeing valid operation of the microprocessor after power up.

In addition to a microprocessing unit and power reset circuit, the initiating and coordinating means may also contain a means for programming the microprocessing unit. The programming means allows the user to directly interface with and program the microprocessing unit and to configure the monitoring apparatus for his own unique application. The programming means (operator interface) may include a keyboard as well as audio and visual indicator means. The keyboard allows the operator to program, and thereby directly interface with, the microprocessing unit. In one embodiment of the invention, the keyboard consists of a twelve key keypad with keys labelled [*], [#], [0], [1], [2], [3], [4], [5], [6], [7], [8], and [9]. Here, the keypad is matrix encoded with 4 rows and 3 columns. The columns are connected to 3 output lines on the microprocessing unit, and the rows are connected to 4 input lines. Each unique row-column address is scanned by the microprocessing unit when looking for a key depression. When the unit is operational, the programming means continuously waits for user input by way of the keypad. When the microprocessing unit detects a key depression, it executes specific preprogrammed routines to validate and debounce that key depression.

A user operates the programming means by employing a simple set of commands and command formats. To initiate any given function, the user presses the command initiation key on the keypad, [*], followed by a command key, [0]-[9], followed by a four digit security code. In some instances the above sequence can be followed by a second command key and a second security code.

Up to four security codes can be maintained by the system, all of which are programmable. When four security codes are used, the first is referred to as the master code, and the other three are referred to as user codes. When the apparatus is first installed, the selected security codes are programmed to a preset code referred to as the installer's code. This gives the installer access at installation to all functions necessary for proper installation of the apparatus. Upon completion of the installation procedure, the owner of the system can use the installer's security code to reprogram the master security code, giving the owner exclusive access to the system functions. Up to three user codes are provided to allow the owner to give temporary access to the system functions to selected individuals. However, only the master code allows the user to reprogram the security codes in the apparatus.

The programming means may also include audio and visual indicator means. In one embodiment of the apparatus, the audio and visual indicator includes a beeper mechanism and four indicators. The beeper is provided for audio feedback of operator interaction and for certain condition signalling. A potential beeper mechanism is the commercially available Mallory MCP320B2 piezoelectric device. One output line from the microprocessing unit drives a PNP emitter follower, which drives and provides sufficient current drive for the beeper device.

In that same embodiment, the indicators are four light emitting diodes (LED's), each of which emits a colored light and is designed to alert the operator of a particular system condition. This particular audio and visual indicator means has one yellow, one green and two red light emitting diodes. The yellow LED is an "alarm/alert detection" indicator, while green LED indicates that the apparatus is in a "standby/ready" condition. Of the two red LED's, one functions as a "system error" indicator, while the other serves as a "power on/battery on" indicator. Each indicator is in one of four states during operation of the apparatus: (1) off, (2) on, (3) blinking slow or (4) blinking fast. The possible indicator states and a brief description of what each represents are shown in Table I below. Concepts or embodiments referred to in Table I that have not yet been discussed will be addressed in a subsequent portion of this description.

TABLE 1

| Indicator (Indicator State) | Off | On | Blink Slow | Blink Fast |
|---|---|---|---|---|
| System Error (Red) | No Error | — | Transducer Error | Security Error |
| Detection (Yellow) | No Detection | — | Object Detected | — |
| Ready (Green) | Not Ready | Ready | Armed Alert | Armed Alarm |
| Power (Red) | Power Off & No Battery Backup | Power On | Battery Backup | |

The four indicators are controlled by the microprocessing unit according to preprogrammed conditions and procedures. Four output lines from the microprocessing unit each drive a PNP emitter follower to provide sufficient current drive for each LED.

Once the user has programmed, or armed, the apparatus, a series of three operational phases begins. That series includes an index synchronization phase, a calibration phase and a monitoring phase. The first phase, the index synchronization phase, synchronizes the activity of the initiating and coordinating means and associated programming means with the activities of the wave generating and detecting means. The index synchronization means will be discussed in detail in a subsequent portion of this description.

After the index synchronization phase, a calibration phase begins. The initiating and coordinating means instigates the production of a calibrating pulsed electrical signal (hereinafter "calibrating pulse") when the body of water to be monitored is free from all foreign objects. The calibrating pulse is transmitted to transducer means for generating and detecting a sound wave in a body of water. In response to the calibrating pulse, the transducer means generates a calibrating sound wave (hereinafter "calibrating wave") which is radiated through the body of water to be monitored. The calibrating wave moves away from the transducer means until it contacts a known solid boundary, such as the side of a swimming pool. After contact, an echo (hereinafter "calibrating echo") is produced that is reflected back to and detected by the transducer means that generated the calibrating wave. Secondary pulses are reflected out to the boundary surface and back along the primary transmission paths as described above. The transducer means converts the calibrating echoes back to electrical signal bursts, processes them, and transmits them back to the initiating and coordinating means.

The initiating and coordinating means, through a calculating means, then calculates a statistical time value from generation of the calibrating pulse to detection of the calibrating echoes. That time is identified as the calibrated time value and is stored by a data storage means located in the initiating and coordinating means. The position in time in which the calibrating echoes are received is an indication of the current geometry of the body of water being monitored. If no echo is received, the time corresponding to the maximum range of the particular wave generating and receiving means being used is logged and stored.

The data storage means is preferably a random access memory computer chip (RAM) which has the capability to log and store all of the statistics of the apparatus. Additionally, the data storage means may contain a clock calendar chip to maintain the time of day and calendar date. That information can then be logged and stored in the RAM. The clock calendar chip and RAM chip directly interface to the microprocessing unit by way of three output lines and 1 bi-directional I/O line.

With reference to the invention as involving a plurality of transducer means, each such means is sequentially calibrated. Accordingly, a first calibrating pulse is produced for and transmitted to a first transducer means, which in turn generates a first calibrating wave that radiates through the body of water to be monitored until it contacts a known solid boundary surface, e.g., the wall of a swimming pool, in its path. First calibrating echoes are reflected back from the boundary surface and travel back to and are detected by the first transducer means that generated the corresponding calibrating wave. The elapsed time measurement is then logged in the dam storage means. A second calibrating pulse is then produced and transmitted to a second transducer means, which in turn generates a second calibrating wave. The second calibrating wave radiates through the body of water to be monitored until it contacts a known solid boundary in its path. Upon such contact, calibrating echoes are reflected back to and detected by the second means that generated the corresponding calibrating wave. The elapsed time measurement is then logged in the data storage means. The process continues sequentially until a calibrated time value has been logged and stored for each transducer means in the system.

After the calibration phase ends, the monitoring phase begins. As such, the initiating and coordinating means instigates the production of a monitoring pulsed electrical signal (hereinafter "monitoring pulse"). The monitoring pulse is transmitted to the transducer means. In response to the monitoring pulse, the transducer means generates a monitoring sound wave (hereinafter "monitoring wave"), which radiates through the body of water being monitored. The monitoring wave moves through the water until it contacts solid objects. After contact, echoes (hereinafter "monitoring echoes") are produced and are reflected back to and detected by the same transducer means that generated the corresponding monitoring wave. The transducer means converts the echoes back to electrical signals hereinafter identified as "response monitoring pulses". These pulses are transmitted back to the initiating and coordinating means where the pulses are processed and stored in the data storage means.

The statistical time value from generation of the wave to detection of the signals is then calculated by the calculating means in the initiating and coordinating means. The comparison means in the initiating and coordinating means then compares the elapsed time from generation of the monitoring pulses to detection of the response monitoring pulses (hereinafter "monitoring travel times") with the predetermined calibrated time value. If the monitoring travel times have changed with respect to the predetermined calibrated time value, the monitoring wave must have necessarily contacted a solid object that is closer to the transducer means than the known boundary surfaces.

In the normal case of employing a plurality of transducer means, monitoring pulses are sent to several transducer means sequentially. Any object located in the path of a particular monitoring wave will cause the production of monitoring echoes that will be reflected back to the appropriate transducer means. The transducer means converts the monitoring echoes to response monitoring pulses, which are processed, and transmitted back to the initiating and coordinating means. The monitoring travel times are compared to the corresponding predetermined calibrated time value for that particular transducer means. If the monitoring travel times have changed with respect to the predetermined calibrated time value, an object other than the known boundary has intruded into the body of water being monitored.

If the initiating and coordinating means, through the calculating and comparison means discussed above, detects the presence of a foreign object in the body of water being monitored, that presence is indicated by an alarm means. In one embodiment of the apparatus, two double pole double throw relays are provided for external alarm and alert conditions. The alarm relay provides two normally open and/or normally closed switches in the event of alarm condition and can be used to interface to an external horn, security system or paging system. One output line is provided by the microprocessing unit for each relay. Each such output line drives a PNP emitter follower drive transistor which in turn drives the relay, thus providing sufficient drive current to the relays. In that same embodiment, two arming conditions are provided on the apparatus, arm-alarm and arm-alert. In the case of monitoring a residential swimming pool, for example, the arm-alarm can be engaged when residents are not home, while the arm-alert condition can be used when residents are home. This allows for the signaling of separate equipment for the two operational conditions.

Figure 8:
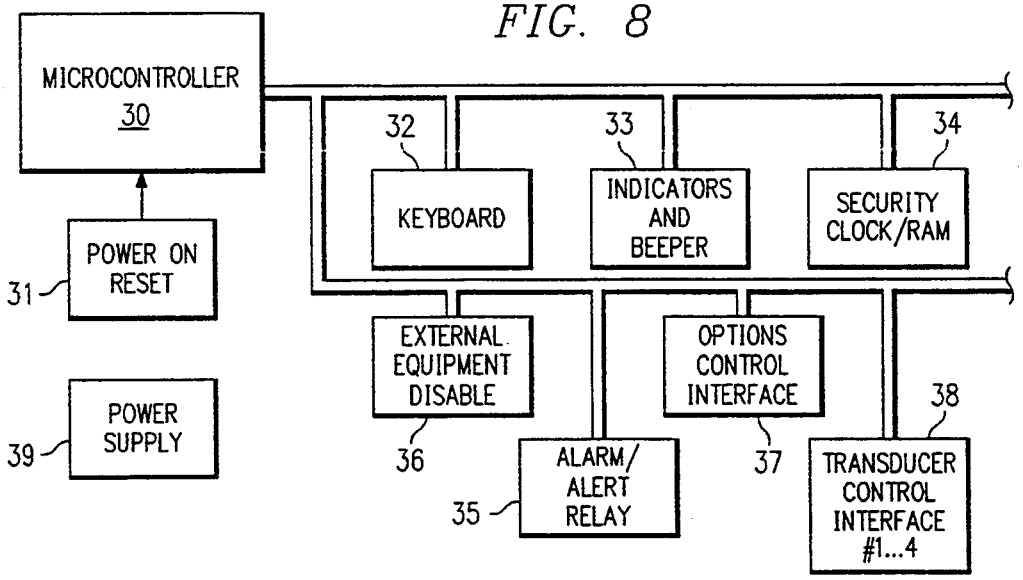
FIG. 8 is a schematic illustration showing a block diagram of a control module for use in the present invention.

In one embodiment of the invention, the instigating and coordinating means and alarm means are housed in a control module. FIG. 8 illustrates one such control module. The control module shown in FIG. 8 can be placed in any accessible location, but is preferably mounted on a vertical surface located near the body of water to be monitored, for example the side of a house near a swimming pool.

Any of the features discussed above can be included in the control module. As shown in FIG. 8, the control module includes an initiating and coordinating means comprised of a microprocessing unit 30 and associated power on reset circuit 31, a programming means including a keyboard 32 and indicators and beeper 33 for operator interface. Additionally, data storage means comprised of a RAM and security clock 34 is provided. FIG. 8 also includes an alarm means consisting of an alarm/alert relay 35.

In addition to those features discussed above, the control module may also include a number of other features. These features include, as shown in FIG. 8, an external equipment disable 36, an options control interface 37 and a transducer control interface 38. The external equipment disable 36 serves to disable the apparatus, for example, if the apparatus is in the armed state during the operation of pool maintenance equipment that could cause a false alarm. The external equipment disable 36 comprises a two line input circuit used to detect a change from open to closed or closed to open circuit condition. The two lines are conditioned by resistor divider capacitor combinations. Each line is divided into an unbalanced ratio, such that an open circuit condition yields a different binary output code than a closed circuit condition. The binary code formed is monitored by the microprocessing unit 30 to determine a change of state. The lines are also conditioned to prevent damage to the microprocessing unit 30 in the event of high voltage connections made to the input lines.

The options control interface 37 allows the apparatus to connect with and control multiple external options and equipment. The options control interface 37 includes a two line full duplex serial communication interface which is implemented by the microprocessing unit. Drivers and receivers are provided to allow for sufficient line lengths to accommodate a large range of home applications.

Figure 9:
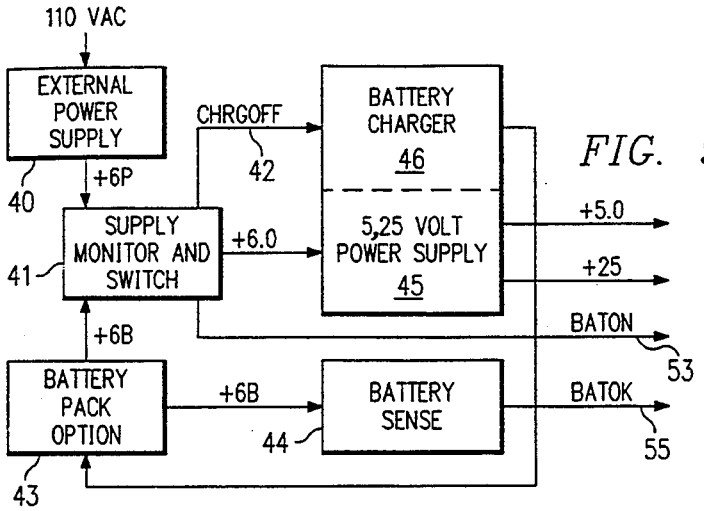
FIG. 9 is a schematic block diagram of a power supply system for the present invention.

The system of FIG. 8 also includes a power supply 39. FIG. 9 illustrates in detail one embodiment of a suitable power supply mechanism which includes of an external power supply 40, a supply monitor and switch 41, a battery pack option 43, a battery sense unit 44 and a battery charger 46.

The external power supply 40 is an external dc supply used to convert 110 volts ac 60 Hz household power to a 6 volt dc source to operate the apparatus. Although the 6 volt dc supply is readily available from most in-home security systems, it can, in the alternative, be provided with the system embodying the present invention. The battery pack option 43 is a 4 amp-hour, 6 volt battery pack capable of powering the apparatus in the event of a power failure.

The supply monitor and switch 41 take the form of a circuit which continuously monitors the 6 volt dc power (+6 P). When the 6 volt dc power drops below an appropriate threshold, the battery pack option 43 is automatically switched on. As such, the apparatus continues to operate without interruption. A battery on status line (BatOn 53) is applied to the microprocessing unit to indicate that the battery pack option 43 has been switched in. The supply monitor and switch 41 consist of a 2 pole double throw relay that is energized by the 6 volt dc power (+6 P). The first pole of the normally open contact routes the 6 volt dc to the output (+6.0). The second pole is used to switch the battery on status line (BatOn 53) off and a battery charging circuit disable line (ChrgOff 42) off. When the 6 volt power fails, the relay is released causing the battery to be switched to the output, and the battery on status line (BatOn 53) and battery charging circuit disable (ChrgOff 42) to be turned off. The output of the supply monitor 41 is sent to an internal power supply 45 to generate 5 and 25 volt dc supplies for internal system use.

The 25 volt supply is a switched capacitor mode voltage converter and is used to step up the 6.0 volts to 25 volts. The 25 volt supply is used by the battery charger circuit and the transducer interface circuits. The 5 volt supply is simply an RC filter of the raw +6.0 power at the input. This is done to minimize any voltage transients to the microprocessing unit during switch over from main to battery power.

The battery charger 46 is a hybrid constant voltage/-constant current source charger. When the battery is sufficiently discharged, the battery charger 46 acts as a constant current charger. This causes maximum charger current flow to minimize the charge time. After the battery has charged to the 90% level, the battery charger 46 acts as a constant voltage float charge circuit. This is done to maximize battery life.

The battery sense unit 44 is a circuit which monitors the condition of the battery pack option 43 to determine when a low battery voltage exists. A battery o.k. status line (BatOk 55) is output to the microprocessing unit to indicate a not low battery condition. The battery sense circuit consists of a transistor comparator circuit, which compares a fraction of the battery voltage to a known voltage reference (2.5 volts). The voltage reference circuit is implemented with a TL431 programmable shunt regulator.

Returning to FIG. 8, the control module also contains a transducer control interface 38. As explained above, the initiating and coordinating means instigates the production of a pulsed electrical signal. That pulsed electrical signal must be communicated to the transducer means for generating and detecting a sound wave in the body of water being monitored. The transducer control interface 38 plays a role in this communication process as will be discussed in detail subsequently.

Figure 10:
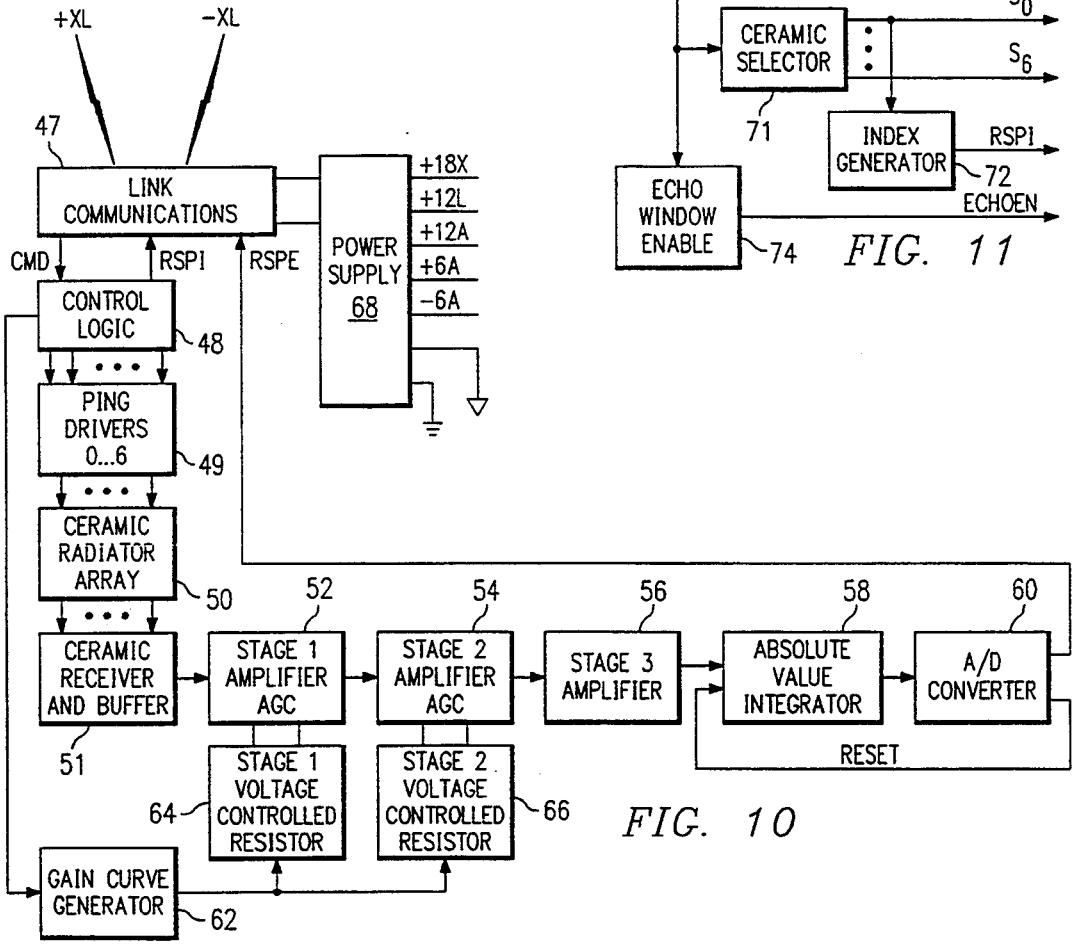
FIG. 10 is a schematic block diagram showing the electronic components of a transducer module embodied in the present invention.

In one embodiment of the invention, illustrated in FIG. 10, the transducer means together with the communication and driving means are housed in a transducer module. As shown in FIG. 10, each of the features discussed above with respect to both the transducer means and the communication and driving means can also be housed in the transducer module. FIG. 10, for example, illustrates a communication and driving means including a link communication module 47, a control logic 48, and ping drivers 49 for the transducers as well as multistage amplification and gain control means for operating on the received signals.

The link communication module 47 both decodes pulsed electrical signals from the initiating and coordinating means to the transducer means, and encodes responses from the transducer means to the initiating and coordinating means. In one embodiment, the link communication 47 includes a loop current modulation detector and a link voltage modulation transmitter. The loop current detector is implemented with an NPN switching transistor where a series resistor monitors the link loop current by modifying the base emitter voltage on the transistor. When the loop current drops below some nominal threshold, the transistor turns off, generating an active high command signal at its collector. An LC tank circuit is provided to route unwanted current fluctuations away from the base-emitter junction. The link voltage modulation transmitter is implemented with an NPN common emitter transistor. The pulsed electrical signals appearing at RSPI and RSPE cause the transistor to turn on and thereby modulate the link interface voltage. This link interface voltage modulation is monitored by the initiating and coordinating means (programming means).

The control logic 48 implements all the coordinating logic to sequence the activities of the transducer means. This is illustrated in detail in FIG. 11. The logic system of FIG. 11 includes a command buffer 68, a keyed oscillator 70, a ceramic selector 71, an index generator 72 and an echo window enable 74.

The command buffer 68 serves to condition the pulsed electrical signal, also referred to as a command signal, that is received from the initiating and coordinating means. One example of a command buffer includes a schmitt trigger cmos nand gate which produces an active low clock, or buffered, signal (/Clk). Th e/Clk signal drives the keyed oscillator 70. The /Clk signal is delayed by an RC circuit to produce a delayed clock signal (/ClkDel), which is used by the echo window enable 74.

The keyed oscillator 70 is an oscillator which is gated on, or keyed, by the buffered command signal (/Clk). Though an oscillator ranging from 400 kHz up to 1000 kHz is permissible, a 500 kHz oscillator is preferred. The keyed oscillator oscillates in response to the buffered command signal (/Clk), thereby producing a ping signal, which will be transmitted to the wave generating and echo detecting means. The ping signal is off when no pulsed electrical signal from the initiating and coordinating means is present, and is a 50% duty cycle clock signal for the duration of the buffered command signal (/Clk). The keyed operation of this circuit minimizes the power dissipation by preventing the keyed oscillator 70 from running continuously.

Figure 11:
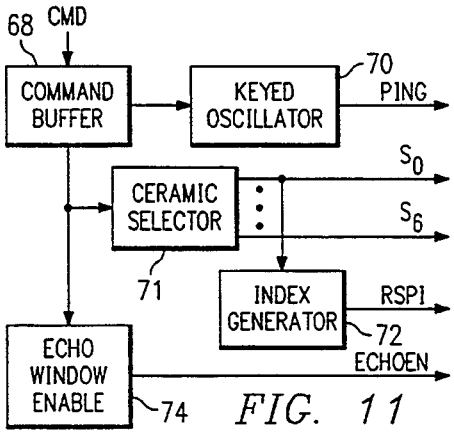
FIG. 11 is a schematic block diagram of a suitable control logic, as referred to in FIG. 10, for use in implementing the present invention.

As illustrated in FIG. 11, the control logic also includes a ceramic selector 71. The ceramic selector 71 selects which transducer means will receive a particular ping signal. Accordingly, the ceramic selector 71 is equipped with a clocking mechanism, for example, a 3 bit counter/decoder. The ceramic selector circuit is clocked once on every ping cycle to automatically select the next sequential wave generating and echo detecting means to receive the next ping signal. After all of the transducer means have been consecutively "pinged", the counter circuit automatically resets itself to once again select the first wave generating and echo detecting means.

As further shown in FIG. 11, the control logic may also include an index generator 72. Where a plurality of transducer means are present in a particular embodiment of the invention, the index generator 72 helps to synchronize the functioning of the transducer means with those of the initiating and coordinating means. The index generator 72 is the mechanism by which the synchronization phase referred to previously is accomplished. Synchronization is carried out by pinging each transducer means sequentially. When the transducer means is pinged, the index generator 72 produces a pulse, referred to as an index pulse, which is transmitted back to the initiating and coordinating means. The index pulse informs the initiating and coordinating means that the first transducer means is the next in sequence to be pinged. This process provides synchronization for the initiating and coordinating means so that the initiating and coordinating means can determine which transducer means is being pinged at any given point in time. The synchronization process described above occurs not only during the synchronization phase, but also continually throughout the monitoring phase.

The control logic may also include a gating means provided by an echo window enable 74. The echo window enable 74 is a circuit which produces an active high echo enable signal, which is active only during the time in which an echo is expected. This prevents any spurious echo signals from being detected and transmitted back to the initiating and coordinating means. The echo enable circuit is triggered by the buffered command signal (/Clk). Upon receipt of the/Clk signal, the TLC555 one shot timer is fired, the pulse duration of which establishes the end of the echo window enable. The output of the TLC555 drives a NAND gate, which is gated with the delayed version of the buffered command signal (/ClkDel). This establishes the beginning time of the echo window enable.

The entire sequence is such that when a pulsed electrical signal (command signal) is received from the initiating and coordinating means, the selected transducer means is pinged for the signal (command) duration, after which a delay time is established to allow a small window for the index pulse to be transmitted back to the initiating and coordinating means. After the index window time, the echo window time exists to allow the receiver to process any echoes and transmit them back to the initiating and coordinating means. Upon completion of the echo window time, the transducer means goes into an idle state and awaits the next ping command.

In addition to the link communications and control logic, the communication and driving means may also include one or more drivers as shown in FIG. 10. Each wave generating means has its own associated driver, referred to as a ping driver 49. Each ping driver 49 includes a gating mechanism, which gates the ping signal from the keyed oscillator with [one select S0 . . . S6] to produce a gated ping signal. The gated ping signal drives an emitter follower, which in turn drives a MOSFET transistor. The emitter follower increases the current source and sink capability to provide fast rise and fall times in the gate circuit of the MOSFET transistor.

Once conditioned and gated, the ping signal is applied to the transducer means. The apparatus contains at least one transducer means, and preferably, a plurality of transducer means. In one type of transducer module, seven transceivers are used. Typically, each transceiver is a barium titanitc, piezoelectric ceramic transducer. The transducer produces mechanical vibrations in response to the application of the gated ping signal. These mechanical vibrations result in the generation of a sound wave that is radiated through the body of water being monitored. The sound wave radiates until it comes in contact with a solid object in its path. After contact, echoes are produced that are reflected back to and detected by the transducer that generated the associated sound wave. The transducer then converts the echoes back to electrical signals and these are processed by the processing means. The processed signal is communicated back to the initiating and coordinating means via the communication and driving means. Once the processed signal is received by the initiating and coordinating means, the calculating means, comparison means and alarm means perform their respective calculating, comparing and alarming functions as described in detail above.

As shown in FIG. 10, the ping driver 49 outputs are applied to a ceramic radiator array 50 which in one embodiment of the invention comprises seven piezoelectric ceramic transducers, sometimes referred to as ceramic radiators. Each transducer in the ceramic radiator array 50 is designed and oriented to transmit or radiate its acoustic pulse in a specific direction and angular spread, known as its radiation pattern. The radiation pattern is directed horizontally and is conular in shape, where the base is wider than the height as described earlier. The transducers are mounted in the ceramic radiator array 50 in semicircle fashion such that sides of each conular radiation pattern are adjacent. The effect is to divide the body of water being monitored into individual pie pieces, thus effectively covering the entire expanse of the monitored body of water.

Each transducer in the ceramic radiator array 50 is designed to operate as a high Q resonator to selectively transmit and receive signals at its resonant frequency. This provides for high noise immunity and the ability to discriminate between echoes caused by reflections of the acoustic signals and ambient noise produced by any other source.

As further shown in the embodiment of FIG. 10, a transducer module also contains a ceramic receiver and buffer 51, one or more amplifiers 52, 54, 56 and associated gain control means 62, 64, 66, an absolute value integrator 58, and an A/D converter 60. In one embodiment, the ceramic receiver and buffer 51 consists of seven FET switches which each select one transducer means to monitor for echoes. The ceramic select lines which select a given transducer means to be pinged are also used in selecting the transducer means to be monitored. The seven switches are collectively enabled by an EchoEn signal. The output of the selector switches are fed to shunt FET switch. This is to prevent the ping signal or monitoring wave from being processed as an echo.

The transducer module may also incorporate one or more amplifiers and one or more associated automatic gain control means. The specific embodiment shown in FIG. 10 contains three such amplifiers, two of which have an associated gain control means; a stage one amplifier and automatic gain control 52, a stage two amplifier and automatic gain control 54, and a stage three amplifier 56. The stage one amplifier 52 is implemented with a two stage amplifier configured as a high gain inverting amplifier. The gain of the two stage amplifier is accurately controlled by a precision feed back resistor. The automatic gain control mechanism associated with the stage one amplifier 52 is implemented by using a voltage controlled resistor circuit as the input series resistor. The ratio of the feed back resistor and the voltage controlled resistor determines the stage one gain. Power supply decoupling is provided by a RC low pass filter. A bandpass filter is placed on the output of the amplifier to selectively filter only the ping signal and attenuate all other components generated by distortion of the ping signal and ambient noise. In the case of a strong ping signal, two clipping dimes are placed on the output of the amplifier to limit the peak signal strength to approximately 200 to 400 mV.

The stage two amplifier 54 is identical to the stage one amplifier 52. The stage two amplifier 54 and stage one amplifier 52 in cascade form a square of the gain control curve. This square of the gain control curve compensates for the logarithmic attenuation of the acoustic ping signal with distance, as described above with reference to FIG. 7, and thus, with respect to elapsed time as it travels through the water.

The stage three amplifier 56 is identical to the stage two amplifier 54 except that the gain is set to a fixed value. No automatic gain control is used. Additionally, no signal limiting diodes are used.

As FIG. 10 indicates, an absolute value integrator 58 may also be present in a transducer module. The absolute value integrator integrates the positive peaks of the echoes of the analog signal processed by stages one, two and three amplifiers. Additionally, a missing pulse detector is provided to determine the end of the echo signal. At the end of the echo signal, the voltage at the output of the integrator is passed to the analog to digital converter 60 for conversion. The A/D converter converts the output of the integrator, which is representative of the level of energy present in the echo, to a digital pulse width form for transmission to the initiating and coordinating means.

The gain curve generator 62 integrates a constant current from the falling edge of /EchoEn to the rising edge of /EchoEn. This produces a linear ramp or an $f(t)=kt$ function. When /EchoEn is on or low, the FET switch is off allowing the capacitor to integrate the constant current source, thus producing the ramp. A matched differential NPN pair is used to accurately reflect the voltage on the capacitor to the output without loading the capacitor. The ramp generated by the gain curve generator 62 is used to control the voltage control resistor circuits 64 and 66.

The transducer module may contain one or more voltage controlled resistors. The embodiment of the transducer module shown in FIG. 10 contains two such resistors, stage one, 64 and stage two, 66. In the stage one voltage controlled resistor 64, the matched PNP differential transistor pair regulates the voltage at the drain of the FET by comparing the voltage on the drain of the FET to a reference voltage generated by a LM334Z programmable current source and precision resistor. The result of this comparison generates an error voltage which is amplified by the differential pair and is used to control the gate voltage of the FET. The effect of this drain voltage regulation is to vary the drain-source resistance of the FET to regulate the voltage drop across it caused by the input control voltage from the gain curve generator 62. This causes a linear 1/t resistance variation which when applied to the amplifier gain control 52, 54 results in a linear gain function with respect to time ($A(t)=kt$). The gain of two cascading amplifiers 52, 54 controlled in this manner results in a square gain function ($A(t)=k^2t^2$). The stage 2 voltage control resistor circuit 66 is identical to stage one circuit 64.

A transducer module such as the one shown diagrammatically in FIG. 10 should be positioned inside the body of water being monitored, preferably mounted on a smooth, vertical surface between 6 to 18 inches below the surface of the water depending upon the transducer module used. Mounting the transducer module in this fashion will prevent false alarms from the detection of objects such as leaves, that routinely (frequently) fall into swimming pools and are suspended on or slightly below the surface.

One embodiment of the present invention contains both a control module, such as the one shown in FIG. 8, and one to four transducer modules, such as the one diagrammed in FIG. 10. In many cases, only one transducer module will be needed. To accommodate unusually shaped bodies of water up to four transducer modules can be employed, and if necessary, even more can be used.

For each transducer module, a transducer support of the type shown in FIG. 3 and usually containing from 1 to 7 transceivers can be located on the wall of the swimming pool or other body of water being monitored at appropriately spaced locations. As a practical matter, the transmission path from one or more transceivers associated with one transducer support will intersect the transmission paths of one or more transducers on another transducer support by at least 90°. It will be recognized that regardless of whether the transducers used in carrying out the present invention are configured on one or on a plurality of transducer supports that the format described above in which the transducers are sequentially pinged should be used.

Having described specific embodiments of the present invention, it will be understood that modifications thereof may be suggested to those skilled in the art, and it is intended to cover all such modifications as fall within the scope of the appended claims.

What is claimed:

1. In a monitoring system for use in detecting a foreign object in a body of liquid such as in a swimming pool or the like, the combination comprising:

a) at least one transducer support adapted to be immersed in a body of liquid;

b) a plurality of electro acoustic transducer means mounted on said support for transmitting acoustic energy directionally away from said support along outward conical transmission paths and for producing an output signal in response to received acoustic energy;

c) each of said transducer means being configured on said support with the active faces thereof oriented to transmit acoustic energy away from said support in complementary conical transmission paths defining different sectors of a field to be monitored;

d) control means for sequentially activating said transducer means to generate a series of time spaced acoustic pulses sequentially from said transducer means at time intervals sufficient to permit the arrival of a subsequent echo pulse at each of said transducer means before the sequential generation of a pulse from another transducer means; and e) means responsive to a reflected echo being received at one of said transducer means before the expiration of a predetermined time period for generating an alarm function.

2. The system of claim 1, wherein said transducer means are mounted on said transducer support with the active faces thereof oriented in an essentially two dimensional array to define a substantially planar monitored field.

3. The system of claim 2, wherein said transducer means are configured to radiate acoustic energy in conical transmission paths having normal cross-sections of elliptical configuration with a major axis generally oriented in the plane of said monitored field and a minor axis generally normal to the plane of said monitored field.

4. The system of claim 3, wherein the ratio of said major to minor axes is at least 2.

5. The system of claim 4, wherein said ratio is at least 4.

6. The system of claim 3, wherein at least some of said transducer means are oriented to transmit acoustic energy in adjacent conical transmission paths having boundaries in said planar monitored field which at least partially overlap.

7. The system of claim 1, further comprising calibrating means for establishing normal travel times for said plurality of spaced conical transmission paths by generating a plurality of time spaced directional acoustic pulses along said transmission paths in a calibration phase, detecting the times at which corresponding echoes return to said transducer means during said calibration phase, and storing signals representative of said normal travel times for said transmission paths.

8. The system of claim 7, further comprising switch means for energizing and de-energizing said monitoring system and means for activating said calibrating means in response to said switch means being placed in an energizing mode.

9. The system of claim 1, wherein said electro acoustic transducers generate acoustic energy pulses having frequencies within the range of 200–800 kHz.

10. The system of claim 1, wherein said electro-acoustic transducer means produce acoustic energy pulses having pulse durations of no more than 0.1 milliseconds and wherein said-control means activates said transducers to produce a time interval between the generation of one acoustic energy pulse from one of said transducer means and the subsequent energy pulse from another of said transducer means of at least 40 milliseconds.

11. The system of claim 10 wherein said time interval is within the range of about 40–80 milliseconds.

12. The system of claim 10, further comprising means for adjusting the signal output from said electro-acoustic transducer means in response to received acoustic energy as a function of the time interval between said generated acoustic pulse and said subsequent echo pulse.

13. The system of claim 1 wherein said plurality of electro-acoustic transducer means comprise transceivers for generating and receiving acoustic energy.

14. The system of claim 13 further comprising means for gating each of said transceivers mean to render said transceivers inactive during a specified time period upon the activation of another of said transceivers to generate an acoustic energy pulse.

15. The system of claim 1 further comprising a plurality of said transducer supports.

16. In a monitoring system for use in detecting a foreign object in a body of liquid such as in a swimming pool or the like, the combination comprising:

a) at least one transducer support adapted to be immersed in a body of liquid;

b) at least first and second electro acoustic transducer means mounted on said support for transmitting acoustic energy directionally away from said support along outward first and second conical transmission paths and for producing an output signal in response to received acoustic energy;

c) each of said transducer means being configured on said support with the active faces thereof oriented to transmit acoustic energy away from said support in complementary conical transmission paths defining different sectors of a field to be monitored;

d) control means for activating said first transducer means and then said second transducer means to generate a series of time spaced acoustic pulses sequentially from said transducer means at time intervals sufficient to permit the arrival of a plurality of subsequent echo pulses at said first transducer means before the sequential generation of an acoustic pulse from said second transducer means;

e) calibrating means for establishing a normal travel time for each of said first and second spaced conical transmission paths by activating said transducer means to generate a plurality of time spaced directional acoustic pulses along said transmission paths in a calibration phase, and for said first transmission path detecting the times at which a plurality of corresponding reflected echoes return to said first transducer means during said calibration phase and storing a first calibrating time value signal representative of the normal travel time for said first transmission path and for said second transmission path detecting the times at which a plurality of corresponding reflected echoes return to said second transducer means during said calibration phase and storing a second calibrating time value signal representative of the normal travel time for said second transmission path;

f) monitoring means for activating said transducer means to generate a plurality of time spaced directional acoustic energy pulses along said transmission paths in a monitoring phase and for said first transmission path detecting the arrival times at which a plurality of corresponding reflected echoes return to said first transducer means during said monitoring phase and establishing a first monitoring time value signal based upon the arrival times of the corresponding reflected echoes returning to said first transducer means during said monitoring phase and for said second transmission path detecting the arrival times at which a plurality of corresponding reflected echoes return to said second transducer means during said monitoring phase and establishing a second monitoring time value signal based upon the arrival time of the corresponding reflected echoes returning to said second transducer means during said monitoring phase;

g) means for comparing said calibrating time value signals with said monitoring time value signals; and h) means responsive to a detected variance between a calibrated time value signal and a corresponding monitoring time value signal for generating an alarm function.

17. The system of claim 16, wherein said transducer means are mounted on said transducer support with the active faces thereof oriented in an essentially two dimensional array to define a substantially planar monitored field.

18. The system of claim 17, further comprising switch means for energizing and de-energizing said monitoring system and means for activating said calibrating means in response to said switch means being placed in an energizing mode.

19. The system of claim 18, further comprising means for adjusting the output signals from said electro-acoustic transducer means in response to received acoustic energy as a function of the time intervals between a generated acoustic pulse and the subsequent corresponding reflected echo pulses.

20. In a defined body of liquid having a monitoring site and a boundary surface for said body of liquid providing an impedance mismatch with said liquid, a system for monitoring the intrusion of a foreign object into said liquid comprising:

a) a plurality of electro acoustic transducer means immersed in said body of liquid for transmitting acoustic energy away from said transducer means outwardly along diverging conical transmission paths in the direction of said boundary surface and responding to received acoustic energy reflected from said boundary surface;

b) control means for sequentially activating said transducer means to generate a series of time spaced acoustic pulses having time intervals between said pulses sufficient to permit the reception of a reflected echo from said boundary surface at one of said transducer means before the sequential generation of a pulse from another of said transducer means; and c) means responsive to a reflected echo being received at one of said transducer means before the expiration of a pre-determined time period for generating an alarm function.

21. The system of claim 20, wherein said transducer means are located near the surface of said body of liquid but spaced sufficiently below said surface so that said acoustic energy pulses transmitted along said transmission paths are not reflected from the surface of said body of liquid.

22. The system of claim 20, wherein said transmission paths are tilted downwardly with respect to the surface of said body of liquid.

23. The system of claim 22, wherein said transmission paths are tilted downwardly by an angle within the range of 1–3 degrees as measured along the axes of said transmission paths.

24. The system of claim 20, wherein said control means functions for activating said transducer means at time intervals sufficient to permit the arrival at each of said transducer means of a plurality of echo pulses before the sequential generation of an acoustic pulse from another of said transducer means.

25. The system of claim 24, further comprising means for adjusting the signal output from said electro-acoustic transducer means in response to received acoustic energy as a function of the time interval between said generated acoustic pulse and said subsequent echo pulses to compensate for attenuation of said echo pulses in said liquid.

26. The system of claim 20, wherein said transducer means are configured to radiate acoustic energy in conical transmission paths having normal cross-sections of elliptical configuration with a major axis generally horizontal to the surface of said liquid and a minor axis generally normal to the surface of said body of liquid.

27. The system of claim 26, wherein the ratio of said major to minor axes is at least 2.

28. The system of claim 26, wherein the upper boundaries of said conical transmission paths are located within the range of 6–8 inches below said surface of liquid.

29. The system of claim 26, wherein at least some of said transducer means have conical transmission paths that have a directivity angle such that the difference in length of the center line of radiation to a boundary normal to radiation center line and the distance from the transducer to a point on said normal boundary which is one half the directivity angle from the radiation center line is no more than eight inches.

30. The system of claim 20, further comprising calibrating means for establishing normal travel times for said plurality of spaced conical transmission paths by generating a plurality of time spaced directional acoustic pulses along said transmission paths in a calibration phase, detecting the time at which the corresponding echoes return to said transducer means during said calibration phase, and storing signals representative of said normal travel times for said transmission paths.

31. The system of claim 30, further comprising switch means for energizing and de-energizing said monitoring system and means for activating said calibrating means in response to said switch means being placed in an energizing mode.

32. The system of claim 20, wherein said electro acoustic transducers generate acoustic energy pulses have frequencies within the range of 200–800 kHz.

33. The system of claim 20, wherein each of said electro-acoustic transducers produce acoustic energy pulses having a pulse duration of no more than 0.1 milliseconds and wherein said control means activates said transducer means to produce time intervals between the generation of one acoustic energy pulse and the subsequent energy pulse of at least 40 milliseconds.

34. The system of claim 20, further comprising means for adjusting the electric signal output from said electro-acoustic transducer means in response to an acoustic echo as a function of the time at which said acoustic echo is received.

35. The system of claim 20, wherein said plurality of electro-acoustic transducer means comprise transceivers for generating and receiving acoustic energy.

36. The system of claim 35, further comprising means for gating each of said transceivers mean to render said transceivers inactive during a specified time period upon the activation of another of said transceivers to generate an acoustic energy pulse.

37. The system of claim 20, wherein a portion of said transducer means are immersed in said body of liquid at a first monitoring site and another portion of said transducer means are immersed in said body of liquid at a second monitoring site spaced from said first monitoring site.

38. In a method of monitoring for the entry of a foreign object into a body of liquid interposed between a monitoring site in said body of liquid and a boundary surface providing an impedance mismatch with said body of liquid, the steps comprising:

a) generating from said monitoring site a plurality of time spaced directional acoustic energy pulses along a plurality of spaced conical transmission paths in the direction of said boundary surface;

b) for each of said transmission paths detecting an echo of an acoustic energy pulse transmitted along said directional transmission path and reflected from said boundary surface and establishing a normal travel time value for the transmission of acoustic energy from said site to said boundary surface and the return of a corresponding echo; and c) in response to the detection of a reflected echo at a time increment less than the normal travel time value for said monitoring path, generating a signal representative of the presence of a foreign object interposed between said transmission site and said boundary surface.

39. The method of claim 38, wherein said plurality of conical transmission paths are spaced horizontally near the surface of said body of liquid but spaced sufficiently below said surface to be substantially unaffected by wave action on the surface of said body of liquid.

40. The method of claim 38, wherein said conical transmission paths are of an elliptical configuration in normal cross-section with a major axis generally horizontal to the surface of said liquid and a minor axis generally normal to the surface of said body of liquid and terminating at a location within the range of 6–8 inches below said surface of liquid.

41. The method of claim 38, wherein at least some of said transducer means have conical transmission paths that have a directivity angle such that the difference in length of the center line of radiation to a boundary normal to radiation center line and the distance from the transducer to a point on said normal boundary which is one half the directivity angle from the radiation center line is no more than eight inches.

42. The method of claim 38, further comprising the step of establishing a normal travel time for said plurality of spaced conical transmission paths by generating a plurality of time spaced directional acoustic pulses along said transmission paths in a calibration phase, detecting the time at which a corresponding echo returns during said calibration phase, and storing a signal representative of said normal travel time.

43. The method of claim 38, wherein said acoustic energy pulses have frequencies within the range of 200–800 kHz.

44. The method of claim 38, wherein each of said acoustic energy pulses has a pulse duration of no more than 0.1 milliseconds and wherein the time interval between the generation of one acoustic energy pulse and the subsequent acoustic energy pulse is at least 40 milliseconds.

45. The method of claim 38, wherein said acoustic energy pulses and the reflected echoes of acoustic energy are generated and received by electro-acoustic transducers and further comprising the step of adjusting he electric signal output from said electro-acoustic transducers in response to an acoustic echo as a function of the time at which said corresponding echo is received.

46. The method of claim 38, wherein said plurality of acoustic energy pulses are generated from a plurality of electro acoustic transducer means corresponding to said spaced transmission paths and further comprising the step of calibrating each of said transducer means to establish a normal travel time value for said transducer means in accordance with step (b) of claim 38, said calibration being performed each time said transducer means are energized.

47. The method of claim 46, further comprising the step of gating each of said transducer means to render said transducer means inactive during a specified time period upon the activation of another of said transducer means to generate an acoustic energy pulse.

48. In a method of monitoring for the entry of a foreign object into a body of liquid interposed between a monitoring site and a boundary surface providing an impedance mismatch with said body of liquid, the steps comprising:

a) instituting a calibration phase by generating from a plurality of electro acoustic transducers at said monitoring site a plurality of time spaced directional acoustic energy pulses along a plurality of space conical transmission paths in the direction of said boundary surface;

b) for each of said transmission paths detecting an echo of an acoustic energy pulse transmitted along said directional transmission path and reflected from said boundary surface and establishing a normal travel time value for the transmission of acoustic energy from said site to said boundary interface and the return of a corresponding echo; and c) instituting a monitoring phase by generating a plurality of time spaced acoustic energy pulses along said plurality of spaced conical transmission paths and in response to the detection of a reflected echo at a time increment less than the normal travel time value for said transmission path, generating a signal representative of the presence of a foreign object interposed between said transmission site and said boundary surface; said calibration phase being conducted prior to instituting said monitoring phase each time generation of said acoustic energy pulses from said monitoring site is initiated.

* * * * *